United States Patent [19]

Havel

[11] Patent Number: 4,804,890

[45] Date of Patent: Feb. 14, 1989

[54] VARIABLE COLOR COMPLEMENTARY DISPLAY DEVICE

[76] Inventor: Karel Havel, 15 Kensington Road, Apartment #704, Bramalea, On Canada, Canada, L6T 3W2

[21] Appl. No.: 925,543

[22] Filed: Oct. 31, 1986

Related U.S. Application Data

[63] Continuation-in-part of Ser. No. 882,430, Jul. 7, 1986, Pat. No. 4,734,619.

[51] Int. Cl.[4] ..... G09G 3/14

[52] U.S. Cl. ..... 315/169.3; 340/701; 340/762; 340/782

[58] Field of Search ..... 315/169.3; 340/762, 340/782, 701–704, 802, 804, 799, 815.1

[56] References Cited

U.S. PATENT DOCUMENTS

| | | | |
|---|---|---|---|
| 3,911,418 | 10/1975 | Takeda | 315/703 |
| 4,086,514 | 4/1978 | Havel | 340/762 X |
| 4,301,450 | 11/1981 | Smoliar | 340/715 |
| 4,488,149 | 12/1984 | Givens, Jr. | 340/762 |

*Primary Examiner*—David K. Moore
*Assistant Examiner*—Mark R. Powell

[57] ABSTRACT

A display device includes a plurality of variable color display areas arranged in a pattern for selectively exhibiting a plurality of display units. The group of display areas corresponding to the display unit is illuminated in a selected color, and the remaining display areas are illuminated in a color substantially complementary.

6 Claims, 2 Drawing Sheets

VARIABLE COLOR COMPLEMENTARY DISPLAY DEVICE

CROSS-REFERENCE TO RELATED APPLICATIONS

This is a continuation-in-part of my copending application Ser. No. 06/882,430 filed 7-7-86 entitled Display Device with Variable Color Background, now U.S., Pat. No. 4,734,619.

BACKGROUND OF THE INVENTION

1. Field of the Invention

This invention relates to variable color display devices.

2. Description of the Prior Art

A display device that can change color and selectively exhibit characters is described in my U.S. Pat. No. 4,086,514 entitled Variable Color Display Device and issued on Apr. 25, 1978. This display device includes display areas arranged in a suitable display font, such as well known 7-segment font, which may be selectively energized in groups to exhibit all known characters. Each display area includes three light emitting diodes for emitting light signals of respectively different primary colors which are blended within the display area to form a composite light signal. The color of the composite light signal can be controlled by varying the portions of the primary light signals.

SUMMARY OF THE INVENTION

It is the principal object of this invention to provide an improved variable color display device capable of illuminating a group of its display areas in a selected color and the remaining display areas in a complementary color for providing a color contrast therebetween.

It is another object of the invention to provide a variable color display device that exhibits characters in an aesthetically pleasing and harmonious manner.

In summary, a variable color display device of this invention includes a plurality of variable color display areas arranged in a pattern. The displayed character may be exhibited in a desired color, by illuminating a group of display areas, and the remaining display areas may be illuminated in a color substantially complementary to more effectively exhibit the character. Multiplexers are provided for selectively coupling each display area of the display device to non-inverting and inverting buses, to illuminate the display areas either in a desired color or in a color substantially complementary, in accordance with outputs of a decoder which are respectively coupled to the display areas.

Further objects of the invention will become obvious from the accompanying drawings and their description.

BRIEF DESCRIPTION OF THE DRAWINGS

In the drawings in which is shown the preferred embodiment of the invention.

Throughout the drawings, like characters indicate like parts.

DESCRIPTION OF THE PREFERRED EMBODIMENT

Figure 1A:
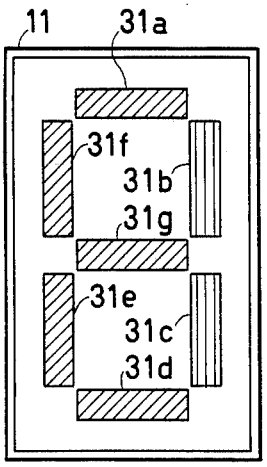
FIG. 1*a* is a plan view of a variable color display device of the present invention on which numeral '1' is illuminated in red color, complementary segments are illuminated in blue-green color.
Figure 1B:
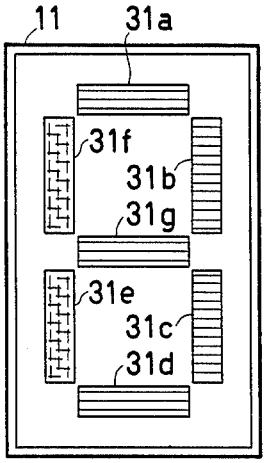
FIG. 1*b* is a similar view of a variable color display device on which numeral '3' is illuminated in blue color, complementary segments are illuminated in yellow color.
Figure 1C:
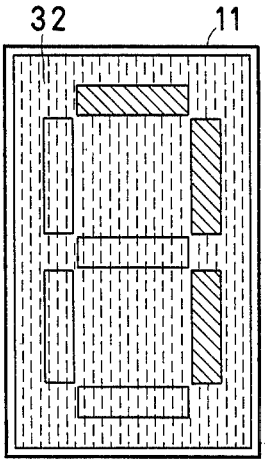
FIG. 1*c* is a similar view of a variable color display device on which numeral '7' is illuminated in green color, complementary segments and display background are illuminated in purple color.

Referring now, more particularly, to the drawings, in FIG. 1*a* is shown a variable color display device 11 of the present invention consisting of seven segments 31*a*, 31*b*, 31*c*, 31*d*, 31*e*, 31*f*, and 31*g* arranged in a well known 7-segment font on which digits and selected characters may be exhibited in variable color. The invention resides in illuminating a group of segments corresponding to the desired character in a selected color and in illuminating the remaining display segments, which are for the purpose of this invention called complementary, in a color definitely different, and preferably complementary, to exhibit the character more effectively. It will be recalled that complementary colors are colors that produce a neutral color when additively mixed in suitable proportions. Generally, red colors are complementary to blue-green colors, green colors are complementary to purple colors, and blue colors are complementary to yellow colors. By referring to several illustrated examples, in FIG. 1*a* is exhibited numeral '1' by illuminating display segments 31*b*, 31*c* in red color in contrast to remaining display segments 31*a*, 31*d*, 31*e*, 31*f* 31*g* illuminated in blue-green color. In FIG. 1*b* is exhibited numeral '3' by illuminating display segments 31*a*, 31*b*, 31*c*, 31*d*, 31*g* in blue color in contrast to remaining display segment 31*e*, 31*f* illuminated in yellow color. In FIG. 1*c* is exhibited numeral '7' by illuminating the group of corresponding display segments in green color in contrast to the remaining display segments illuminated jointly with the display background 32 in purple color. The overall effect of the display in FIG. 1*c* , which is believed to be the best mode of using the invention, is that the complementary display segments blend with the background to provide maximum color contrast between the numeral '7' and its background to facilitate its recognition and exhibit it in an aesthetically pleasing and harmonious manner. A display device with variable color background is described in the above identified copending application.

Figure 2:
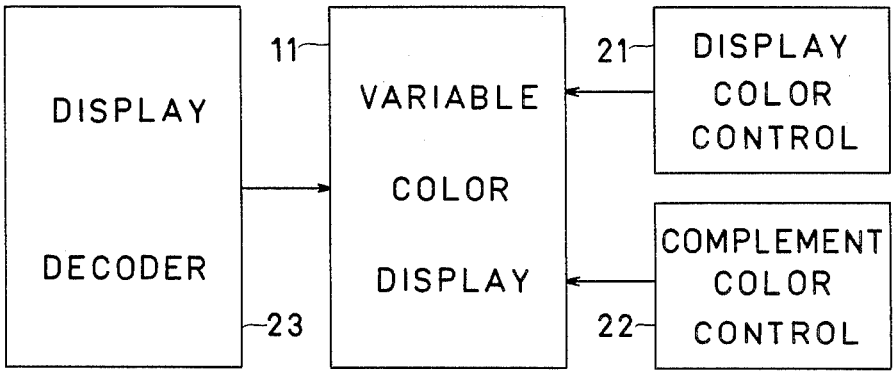
FIG. 2 is a block diagram showing the activation of a variable color display device of the invention.

In FIG. 2 is shown a block diagram of a variable color display system of the invention which includes a variable color display device 11, display decoder 23 for converting input codes to displayable codes to display a desired display unit by activating appropriate groups of display areas, display color control 21 for illuminating the display unit in a desired color, and complement color control 22 for illuminating complementary display areas in a color definitely different from the color of the display unit. The display color control and complement color control may be independent, as illustrated, or complement color may be derived from the display color, as will be pointed out subsequently.

Figure 3:
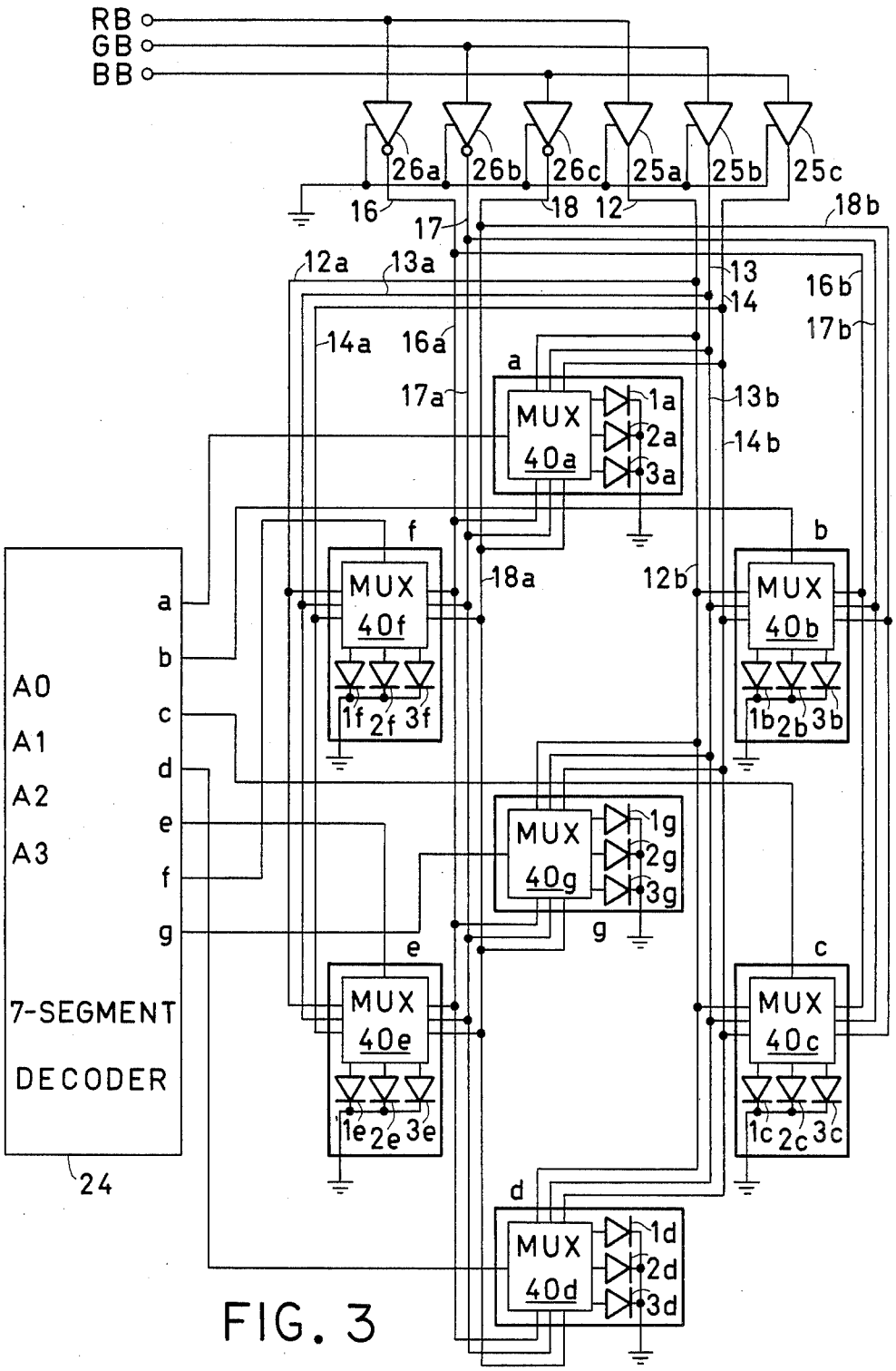
FIG. 3 is a simplified schematic diagram of a variable color display device of the invention.

Proceeding now to the detailed description, in FIG. 3 is shown a simplified schematic diagram of a one-character 7-segment variable color complementary display element of the invention. The circuit employs a common cathode 7-segment decoder 24 which may be substantially conventional.

Each display segment of the display element includes a triad of closely adjacent light emitting diodes (LEDs): a red LED 1, green LED 2, and blue LED 3 which are adapted for producing a composite light signal of a variable color. To facilitate the illustration, the LEDs are designated by segment letters, e.g., red LED in the segment b is shown at 1*b*, green LED in the segment d is shown at 2*d*, and blue LED in the segment f is shown at 3*f*.

The cathodes of all red, green, and blue LED triads are interconnected in each display segment and grounded. The anodes of all red, green, and blue LEDs in each display segment are coupled to outputs of respective multiplexers 40*a*, 40*b*, 40*c*, 40*d*, 40*e*, 40*f*, and 40*g* in a manner that will be more clearly explained subsequently.

A non-inverting buffer 25*a* is utilized to drive two interconnected electrical paths 12*a*, 12*b* referred to as a non-inverting red bus 12. A like non-inverting buffer 25*b* is utilized to drive two interconnected electrical paths 13*a*, 13*b* referred to as a non-inverting green bus 13. A like non-inverting buffer 25*c* is utilized to drive two interconnected electrical paths 14*a*, 14*b* referred to as a non-inverting blue bus 14.

An inverting buffer 26*a* is utilized to drive two interconnected electrical paths 16*a*, 16*b* referred to as an inverting red bus 16. A like inverting buffer 26*b* is utilized to drive two interconnected electrical paths 17*a*, 17*b* referred to as an inverting green bus 17. A like inverting buffer 26*c* is utilized to drive two interconnected electrical paths 18*a*, 18*b* referred to as an inverting blue bus 18. The enable inputs of all buffers are grounded to maintain them enabled.

The color of the display segments may be controlled by applying logic level signals to the bus control inputs RB (red bus), GB (green bus), and BB (blue bus).

The operation of the display element shown in FIG. 3 will be now explained on example of illuminating digit '1' in red color. To exhibit decimal number '1', a BCD code 0001 is applied to the inputs A0, A1, A2, A3 of the decoder 24. The decoder develops high voltage levels at its outputs b, c, to cause equally designated display segments to be illuminated in red color, and low voltage levels at all remaining outputs, to cause all remaining display segments to be illuminated in blue-green color, which is complementary to red.

To illuminate the display unit in red color, the bus control input RB is raised to a high logic level, while both remaining bus control inputs GB and BB are maintained at a low logic level. As a result, the output of the buffer 25*a* rises to a high logic level thereby driving the non-inverting red bus 12 to a high logic level. The outputs of the decoder 24 are used as control signals for causing the LEDs in respective display segments to be coupled either to the non-inverting red, green, and blue buses (for a decoder output being at a high logic level), to illuminate the segment in a desired color, or to the inverting red, green, and blue buses (for a decoder output being at a low logic level), to illuminate the segment in a complementary color.

High logic levels at the outputs b, c of the decoder 24 cause the multiplexers 40*b*, 40*c* to couple the non-inverting red bus 12*b* to red LEDs 1*b*, 1*c*, non-inverting green bus 13*b* to green LEDs 2*b*, 2*c*, and non-inverting blue bus 14*b* to blue LEDs 3*b*, 3*c* , as will be more clearly pointed out subsequently. Since high logic level is only on the non-inverting red bus 12, only the red LEDs 1*b* and 1*c* illuminate. As a result, the display segments b, c illuminate in red color.

Since the bus control inputs GB and BB are at a low logic level, the outputs of inverting buffers 26*b* and 26*c* rise to a high logic level thereby respectively driving the inverting green bus 17 and inverting blue bus 18 to a high logic level. Low logic levels at the outputs a, d, e, f, and g of the decoder 24 cause the multiplexers 40*a*, 40*d*, 40*e*, 40*f*, 40*g* to couple LEDs in equally designated segments to the inverting buses, as will be more clearly pointed out subsequently. The inverting red bus 16*a* is thus coupled to red LEDs 1*a*, 1*d*, 1*e*, 1*f*, 1*g*, inverting green 17*a* is coupled to green LEDs 2*a*, 2*d*, 2*e*, 2*f*, 2*g*, and inverting blue bus 18*a* is coupled to blue LEDs 3*a*, 3*d*, 3*e*, 3*f*, inverting blue bus 18, the green LEDs 2*a*, 2*d*, 2*e*, 2*f*, 2*g* and blue LEDs 3*a*, 3*d*, 3*e*, 3*f*, 3*g* illuminate. As a result of internal blending of green and blue light signals, the display segments a, d, e, f, g illuminate in substantially blue-green color. The overall effect is a numeral '1' illuminated in red color in contrast to all remaining display segments illuminated in blue-green color, as shown in FIG. 1*a*.

To exhibit decimal number '3' in blue color, a BCD code 0011 is applied to the inputs A0, A1, A2, A3 of the decoder 24. The decoder develops high voltage levels at its outputs a, b, c, d, g, to cause equally designated display segments to be illuminated in blue color, and low voltage levels at all remaining outputs, to cause all remaining display segments to be illuminated in yellow color.

To illuminate the display unit in blue color, the bus control input BB is raised to a high logic level, while both remaining bus control inputs RB and GB are maintained at a low logic level. As a result, the output of the buffer 25*c* rises to a high logic level thereby driving the non-inverting blue bus 14 to a high logic level.

High logic levels at the outputs a, b, c, d, g of the decoder 24 cause respective multiplexers 40*a*, 40*b*, 40*c*, 40*d*, 40*g* to couple the non-inverting red bus 12*b* to red LEDs 1*a*, 1*b*, 1*c*, 1*d*, 1*g*, non-inverting green bus 13*b* to green LEDs 2*a*, 2*b*, 2*c*, 2*d*, 2*g*, and non-inverting blue bus 14*b* to blue LEDs 3*a*, 3*b*, 3*c*, 3*d*, 3*g*. Since high logic level is only on the non-inverting blue bus 14, only the blue LEDs 3*a*, 3*b*, 3*c*, 3*d*, 3*g* illuminate. As a result, the display segments a, b, c, d, g illuminate in blue color.

Since the bus control inputs RB and GB are at a low logic level, the outputs of inverting buffers 26*a* and 26*b*, rise to a high logic level thereby respectively driving the inverting red bus 16 and inverting green bus 17 to a high logic level. Low logic levels at the outputs e, f of the decoder 24 cause the multiplexers 40*e*, 40*f* to couple LEDs in equally designated segments to the inverting buses. The inverting red bus 16*a* is thus coupled to red LEDs 1*e*, 1*f*, inverting green bus 17*a* is coupled to green LEDs 2*e*, 2*f*, and inverting blue bus 18*a* is coupled to blue LEDs 3*e*, 3*f*. Since high logic levels are on the inverting red bus 16 and inverting green bus 17, the red LEDs 1*e*, 1*f* and green LEDs 2*e*, 2*f* illuminate. As a result of internal blending of red and green light signals, the display segments e, f illuminate in substantially yellow color. The overall effect is a numeral '3' illuminated in blue color in contrast to all remaining display segments illuminated in yellow color, as shown in FIG. 1*b*.

To exhibit decimal number '7' in green color, a BCD code 0111 is applied to the inputs A0, A1, A2, A3 of the decoder 24. The decoder develops high voltage levels at its outputs a, b, c, to cause equally designated segments to be illuminated in green color, and low voltage levels at all remaining outputs, to cause all remaining display segments to be illuminated in purple color.

To illuminate the display unit in green color, the bus control input GB is raised to a high logic level, while both remaining bus control inputs RB and BB are maintained at a low logic level. As a result, the output of the buffer 25*b* rises to a high logic level thereby driving the non-inverting green bus 13 to a high logic level.

High logic levels at the outputs a, b, c of the decoder 24 cause respective multiplexers 40*a*, 40*b*, 40*c* to couple the non-inverting red bus 12*b* to red LEDs 1*a*, 1*b*, 1*c*, non-inverting green bus 13*b* to green LEDs 2*a*, 2*b*, 2*c*, and non-inverting blue bus 14*b* to blue LEDs 3*a*, 3*b*, 3*c*. Since high logic level is only on the non-inverting green bus 13, only the green LEDs 3*a*, 3*b*, 3*c* illuminate. As a result, the display segments a, b, c illuminate in green color.

Since the bus control inputs RB and BB are at a low logic level, the outputs of inverting buffers 26*a* and 26*c* rise to a high logic level thereby respectively driving the inverting red bus 16 and inverting blue bus 18 to a high logic level. Low logic levels at the outputs d, e, f, g of the decoder 24 cause the multiplexers 40*d*, 40*e*, 40*f*, 40*g* to couple LEDs in equally designated segments to the inverting buses. The inverting red bus 16*a* is thus coupled to red LEDs 1*d*, 1*e*, 1*f*, 1*g*, inverting green bus 17*a* is coupled to green LEDs 2*d*, 2*e*, 2*f*, 2*g*, and inverting blue bus 18*a* is coupled to blue LEDs 3*d*, 3*e*, 3*f*, 3*g*. Since high logic levels are on the inverting red bus 16 and inverting blue bus 18, the red LEDs 1*d*, 1*e*, 1*f*, 1*g* and blue LEDs 3*d*, 3*e*, 3*f*, 3*g* illuminate. As a result of internal blending of red and blue light signals, the display segments d, e, f, g illuminate in substantially purple color. The overall effect is a numeral '7' illuminated in green color in contrast to all remaining display segments illuminated in purple color, as shown in FIG. 1*c*. The background area may be also illuminated in purple color, in a manner disclosed in the above identified copending application.

Figure 4:
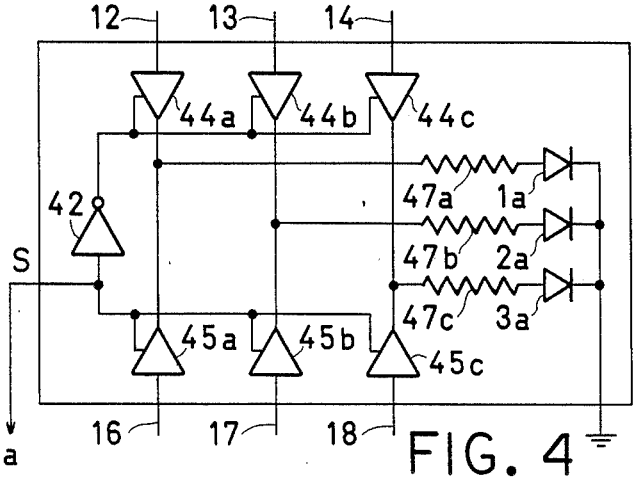
FIG. 4 is a detail of a multiplexer shown generally in FIG. 3.

The multiplexer circuitry, which has been so far discussed only generally, is illustrated in FIG. 4 on example of a detailed schematic diagram of a MUX 40*a* in the display segment a. It will be appreciated that multiplexers in the remaining display segments may be substantially similar. The multiplexer employs two groups of tri-state non-inverting buffers 44*a*, 44*b*, 44*c* and 45*a*,45*b*, 45*c* having outputs interconnected in pairs. It will be recalled that a tri-state non-inverting buffer is a circuit device that can be selectively disabled, for effectively disconnecting its output and thereby providing an open circuit, and enabled, for causing its output to follow logic level of the input. The buffers 44*a*, 44*b*, 44*c* are used for respectively coupling non-inverting buses 12, 13, 14 to the LEDs in the display segment, while buffers 45*a*, 45*b*, 45*c* are used for respectively coupling inverting buses 16, 17 18 to the LEDs.

The coupling relationship is controlled by a logic signal at the select input S, which is connected to the output a of the decoder 24, viewed in FIG. 3. As illustrated, the select inputs of multiplexers in the remaining display segments are respectively connected to equally designated outputs of the decoder. When the select input S is at a high logic level, the interconnected enable inputs of the buffers 45*a*, 45*b*, 45*c* are also maintained at a high logic level to disable same for effectively disconnecting their outputs. The high logic level select signal is inverted by an inverter 42 and applied to the interconnected enable inputs of the buffers 44*a*, 44*b*, 44*c* to enable same for causing their outputs to respectively follow logic levels at the inputs. The output of the buffer 44*a*, which follows the logic level of the red non-inverting bus 12, is coupled via a current limiting resistor 47*a* to the anode of red LED 1*a*. The output of the buffer 44*b*, which follows the logic level of the green on-inverting bus 13, is coupled via a current limiting resistor 47*b* to the anode of green LED 2*a*. The output of the buffer 44*c*, which follows the logic level of the blue non-inverting bus 14, is coupled via a current limiting resistor 47*c* to the anode of blue LED 3*a*. It is readily apparent that the three LEDs in the display segment may be respectively illuminated by applying a high logic level signal to appropriate one of the three non-inverting buses.

Assuming that a high logic level signal is applied to the red non-inverting bus 12, the output of the buffer 44*a* also rises to a high logic level, and current flows therefrom via resistor 47*a* and red LED 1*a* to ground, to illuminate the red LED. Similarly, high logic level signal applied on the green non-inverting bus 13 causes current to flow from the output of the buffer 44*b* via resistor 47*b* and green LED 2*a* to ground, to illuminate the green LED. A high logic level signal on the non-inverting blue bus 14 causes current to flow from the output of the buffer 44*c* via resistor 47*c* and blue LED 3*a* to ground, to illuminate the blue LED. When two or more LEDs are illuminated simultaneously, their emissions are blended within the display segment to obtain light signal of a composite color, as will be more fully explained subsequently.

When the select input S is at a low logic level, the interconnected enable inputs of the buffers 44*a*, 44*b*, 44*c* are maintained at a high logic level, via the inverter 42, to disable same for effectively disconnecting their outputs. The low logic level select signal is applied to the interconnected enable inputs of the buffers 45*a*, 45*b*, 45*c* to enable same for causing their outputs to respectively follow logic levels at the inputs. The output of the buffer 45*a*, which follows the logic level of the red inverting bus 16, is coupled via current limiting resistor 47*a* to the anode of red LED 1*a*. The output of the buffer 45*b*, which follows the logic level of the green inverting bus 17, is coupled via current limiting resistor 47*b* to the anode of green LED 2*a*. The output of the buffer 45*c*, which follows the logic level of the blue inverting bus 18, is coupled via current limiting resistor 47*c* to the anode of blue LED 3*a*. It is readily apparent that the three LEDs in the display segment may be respectively illuminated by applying a high logic level signal to appropriate one of the three inverting buses.

Assuming that a high logic level signal is applied to the red inverting bus 16, the output of the buffer 45*a* also rises to a high logic level, and current flows therefrom via resistor 47*a* and red LED 1*a* to ground, to illuminate the red LED. Similarly, high logic level signal applied on the green inverting bus 17 causes current to flow from the output of the buffer 45*b* via resistor 47*b* and green LED 2*a* to ground, to illuminate the green LED. A high logic level signal on the inverting blue bus 18 causes current to flow from the output of the buffer 45*c* via resistor 47*c* and blue LED 3*a* to ground, to illuminate the blue LED. When two or more LEDs are illuminated simultaneously, their emissions are blended within the display segment to obtain light signal of a composite color.

It would be obvious to those skilled in the art that other steering devices may be utilized for controlling the coupling relationship of the LEDs and the buses.

Figure 5:
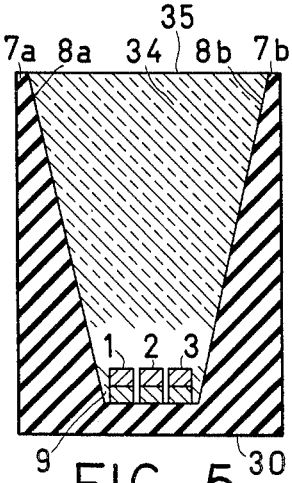
FIG. 5 is a cross-sectional view revealing internal structure of one display segment.

As was pointed out previously, each display area includes a triad of LEDs for emitting light signals of respectively different primary colors. An important consideration has been given to physical arrangement of the LEDs in the display areas, as illustrated in FIG. 5. In each display segment, red LED 1, green LED 2, and blue LED 3 are mounted closely adjacent one another on a support 30 in a light blending cavity 9 and completely surrounded by transparent light scattering material 34. When forwardly biased, the LEDs 1, 2, and 3 emit light signals of red, green, and blue colors, respectively, which are blended by passing through light scattering material 34, acting to disperse the light signals, to form a composite light signal that emerges at the upper surface 35 of the display segment. The color of the composite light signal may be controlled by varying the portions of red, green, and blue light signals.

The display segments are optically separated from one another by opaque walls. In the illustrated display segment, the walls 7*a* and 7*b* have generally smooth inclined surfaces 8*a* and 8*b*, respectively, defining an obtuse angle with the support 30 and defining a display light blending cavity 9 therebetween. Alternatively, the wall surfaces may be rough to further promote diffusion of the light signals. Although the walls and light blending cavity are shown to be of certain shapes and dimensions, it is envisioned that they may be modified and rearranged.

The invention may be now briefly summarized. The method was disclosed of selectively exhibiting display units in a variable color, on a display device including a plurality of variable color display areas, by causing a group of the display areas corresponding to the selected display unit to be illuminated in a selected color and by causing a plurality of remaining display areas to be illuminated in a substantially complementary color.

A variable color display device was disclosed that comprises a plurality of variable color display areas arranged in a pattern, display color control for selectively illuminating groups of the display areas in a selected color to exhibit a plurality of display units, and complement color control for illuminating the remaining display areas in a color definitely different, and preferably complementary. Each display area includes a multiplexer for selectively coupling light sources therein to the non-inverting and inverting buses in accordance with output signals of a decoder.

All matter herein described and illustrated in the accompanying drawings should be interpreted as illustrative and not in a limiting sense. It would be obvious that numerous modifications can be made in the construction of the preferred embodiment shown herein, without departing from the spirit of the invention as defined in the appended claims.

CORRELATION TABLE

This is a correlation table of reference characters used in the drawings herein, their descriptions, and examples of commercially available parts.

| # | DESCRIPTION | EXAMPLE |
|---|---|---|
| 1 | display red LED | |

-continued

CORRELATION TABLE

This is a correlation table of reference characters used in the drawings herein, their descriptions, and examples of commercially available parts.

| # | DESCRIPTION | EXAMPLE |
|---|---|---|
| 2 | display green LED | |
| 3 | display blue LED | |
| 7 | opaque wall | |
| 8 | inclined inner wall surface | |
| 9 | light blending cavity | |
| 11 | variable color display device | |
| 12 | non-inverting red bus | |
| 13 | non-inverting green bus | |
| 14 | non-inverting blue bus | |
| 16 | inverting red bus | |
| 17 | inverting green bus | |
| 18 | inverting blue bus | |
| 21 | display color control | |
| 22 | complement color control | |
| 23 | display decoder | |
| 24 | common cathode 7-segment decoder | 74LS48 |
| 25 | non-inverting buffer | 74LS244 |
| 26 | inverting buffer | 74LS240 |
| 30 | support | |
| 31 | display segment | |
| 32 | background area | |
| 34 | light scattering material | |
| 35 | top surface of display area | |
| 40 | multiplexer | |
| 42 | inverter | 74LS04 |
| 44 | tri-state non-inverting buffer | 74LS244 |
| 45 | tri-state non-inverting buffer | 74LS244 |
| 47 | resistor | |

What I claim is:

1. A variable color display device comprising:

a plurality of variable color display areas arranged in a pattern for selectively exhibiting a plurality of display units in a selected color, each said display area including three light sources for emitting upon activation light signals of respectively different primary colors and means for combining said light signals in each said display area to obtain a composite light signal of a composite color;

a first primary color non-inverting bus;

a second primary color non-inverting bus;

a third primary color non-inverting bus;

a first primary color inverting bus;

a second primary color inverting bus;

a third primary color inverting bus;

means for selectively coupling said light sources in said display areas for emitting light signals of a first primary color to said first primary color non-inverting bus and said first primary color inverting bus;

means for selectively coupling said light sources in said display areas for emitting light signals of a second primary color to said second primary color non-inverting bus and said second primary color inverting bus;

means for selectively coupling said light sources in said display areas for emitting light signals of a third primary color to said third primary color non-inverting bus and said third primary color inverting bus;

display color control means for activating said first, second, and third primary color non-inverting buses in a non-inverting fashion to illuminate all said light sources coupled thereto in a desired color; and complement color control means for activating said first, second, and third primary color inverting buses in an inverting fashion to illuminate all said light sources coupled thereto in a color substantially complementary to said desired color.

2. A variable color display device comprising:

a plurality of variable color display areas arranged in a pattern for selectively exhibiting a plurality of characters in a selected color, each said display area including three light sources for emitting upon activation light signals of respectively different primary colors and means for combining said light signals in each said display area to obtain a composite light signal of a composite color;

decoder means having a plurality of inputs adapted for accepting input codes defining characters to be displayed and a plurality of outputs respectively coupled to said display areas for developing output signals corresponding to said input codes;

a first primary color non-inverting bus;

a second primary color non-inverting bus;

a third primary color non-inverting bus;

a first primary color inverting bus;

a second primary color inverting bus;

a third primary color inverting bus;

means for selectively coupling said light sources in said display areas for emitting light signals of a first primary color to said first primary color non-inverting bus and said first primary color inverting bus in accordance with said output signals of said decoder means;

means for selectively coupling said light sources in said display areas for emitting light signals of a second primary color to said second primary color non-inverting bus and said second primary color inverting bus in accordance with said output signals of said decoder means;

means for selectively coupling said light sources in said display areas for emitting light signals of a third primary color to said third primary color non-inverting bus and said third primary color inverting bus in accordance with said output signals of said decoder means;

display color control means for activating said first, second, and third primary color non-inverting buses in a non-inverting fashion to illuminate all said light sources coupled thereto in a desired color; and complement color control means for activating said first, second, and third primary color inverting buses in an inverting fashion to illuminate all said light sources coupled thereto in a color substantially complementary to said desired color.

3. A variable color display device as defined in the claim 2 more characterized by:

said display color control means having three color control inputs for receiving input signals defining a desired color of said display areas and including three non-inverting buffers having their inputs respectively coupled to said color control inputs and their outputs respectively coupled to said first, second, and third primary color non-inverting buses; and said complement color control means including three inverting buffers having their inputs respectively coupled to said color control inputs and their outputs respectively coupled to said first, second, and third primary color inverting buses.

4. A display device comprising:

a plurality of variable color display areas arranged in a pattern for selectively exhibiting a plurality of display units, each said display area including a plurality of light sources for emitting upon activation light signals of different colors and means for combining said ligtt signals to obtain a composite light signal of a composite color;

first means for carrying selective display color control signals;

converter means for converting said display color control signals to obtain complementary color control signals;

second means for carrying said complementary color control signals; and control means for selectively coupling said light sources in said display areas to said first means, for causing selective ones of said display areas to illuminate in a selected color defined by said display color control signals, and to said second means, for causing the remaining display areas to illuminate in a substantially complementary color defined by said complementary color control signals.

5. A display device comprising:

a plurality of variable color display areas arranged in a pattern for selectively exhibiting a plurality of display units, each said display area including three light sources for emitting upon activation light signals of respsectively different primary colors and means for combining said light signals to obtain a composite light signal of a composite color;

first means for carrying selective first, second, and third display color control signals;

converter means for respectively converting said first, second, and third display color control signals to obtain first, second, and third complementary color control signals;

second means for carrying said first, second, and third complementary color control signals; and control means for selectively coupling said light sources in said display area to said first means, for causing selective ones of said display areas to illuminate in a selected color defined by said first, second, and third display color control signals, and to said second means, for causing the remaining display areas to illuminate in a substantially complementary color defined by said first, second, and third complementary color control signals.

6. A variable color display device comprising:

a plurality of variable color display areas arranged in a pattern for selectively exhibiting a plurality of display units in a selected color, each said display area including three light sources for emitting upon activation light signals of respectively different primary colors and means for combining said light signals in each said display areas to obtain a composite lihgt signalof a composite color;

first bus means for carrying selective first, second, and third display color control digital signals;

inverting means for respectively inverting said first, second, and third display color control digital signals to obtain first, second, and third complementary color control digital signals;

second bus means for carrying said first, second, and third complementary color control digital signals; and multiplexer means for selectively coupling said light sources in said display areas to said first bus means, for illuminating selective ones of said display ares in a selected color defined by said first, sescond, and third color control digital signals, and to said second bus means, for illuminating the remaining display areas in a substantially complementary color defined by said first, second, and third complementary color control digital signals.

* * * * *

UNITED STATES PATENT AND TRADEMARK OFFICE

CERTIFICATE OF CORRECTION

PATENT NO. : 4,804,890
DATED : February 14, 1989
INVENTOR(S) : Karel Havel

It is certified that error appears in the above-identified patent and that said Letters Patent is hereby corrected as shown below:

Column 10,
Lines 16 and 40, change “control means” to -- a multiplexer --.
Line 41, change “area” to -- areas --.

Signed and Sealed this

Seventh Day of December, 2004

JON W. DUDAS
*Director of the United States Patent and Trademark Office*